US005306384A

United States Patent [19]

Stutt

[11] Patent Number: 5,306,384

[45] Date of Patent: Apr. 26, 1994

[54] MACHINE FOR MAKING CORRUGATED BOARD INCLUDING A VACUUM/POSITIVE PRESSURE TRANSFER ROLL

[75] Inventor: Colin Stutt, Bristol, United Kingdom

[73] Assignee: Amcor Limited, Victoria, Australia

[21] Appl. No.: 975,040

[22] Filed: Nov. 12, 1992

Related U.S. Application Data

[63] Continuation-in-part of Ser. No. 678,998, Jun. 28, 1991, abandoned.

[30] Foreign Application Priority Data

Oct. 27, 1988 [GB] United Kingdom ..... 8825145

[51] Int. Cl.[5] ..... B31F 1/28

[52] U.S. Cl. ..... 156/473; 156/205; 156/210; 156/543; 226/95

[58] Field of Search ..... 156/473, 471, 472, 470, 156/568, DIG. 38, DIG. 39, 205, 210, 543; 269/21; 226/95; 425/336

[56] References Cited

U.S. PATENT DOCUMENTS 3,299,906 1/1967 Smith, Jr. et al. ..... 226/95 X
3,513,053 5/1970 Carrel .
3,700,518 10/1972 Ohmori .
3,854,861 12/1974 Worrall ..... 156/210 X
4,338,154 7/1982 Berthelot et al. ..... 156/473 X
4,589,945 5/1986 Polit ..... 156/568 X

FOREIGN PATENT DOCUMENTS 0279609 8/1988 European Pat. Off. .
0321247 6/1989 European Pat. Off. .
393156 12/1908 France .
1494318 9/1967 France .
89/09127 10/1989 World Int. Prop. O. .

*Primary Examiner*—Michael W. Ball
*Assistant Examiner*—Michele K. Yoder
*Attorney, Agent, or Firm*—Seidel Gonda Lavorgna & Monaco

[57] ABSTRACT

A machine for making corrugated board, comprising means to feed two separate webs between two respective pairs of corrugating rolls to form two corrugated layers, a first adhesive application for applying adhesive to the peaks of at least one of the two corrugated layers, means to bring the two corrugated layers together at the peaks of the corrugations, means to convey the joined corrugated layers past a second adhesive applicator for applying adhesive to the exposed peaks of one of the corrugated layers, and means to apply a liner web to the corrugated layer.

7 Claims, 3 Drawing Sheets

Figure 1:
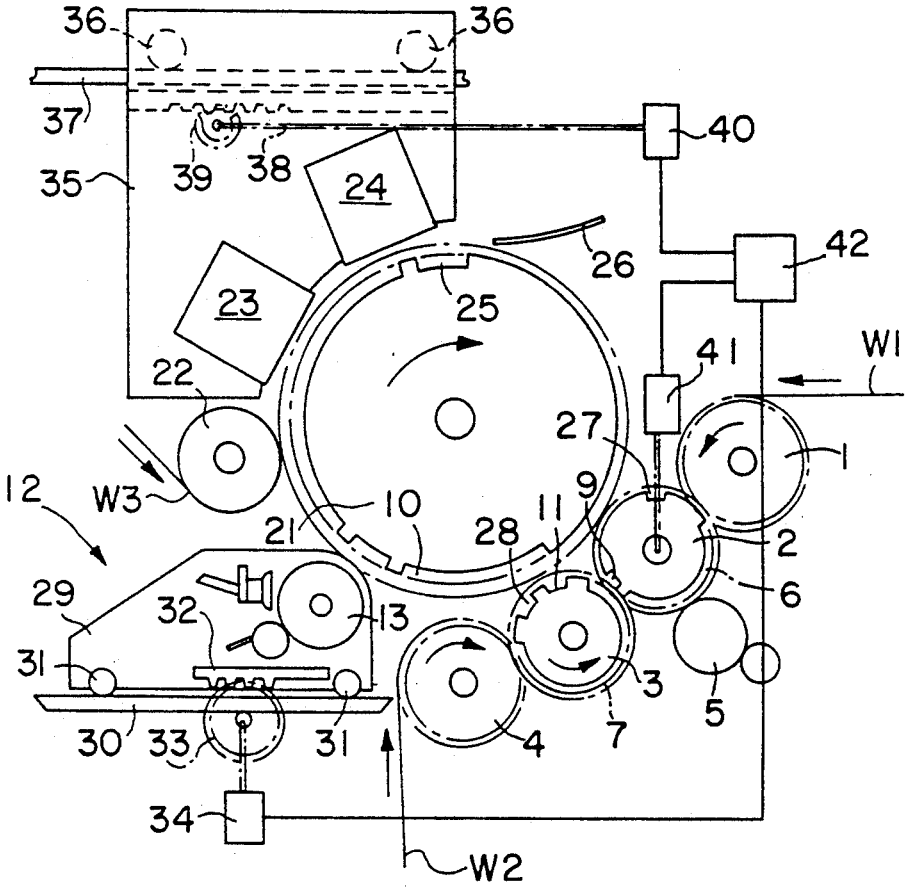

MACHINE FOR MAKING CORRUGATED BOARD INCLUDING A VACUUM/POSITIVE PRESSURE TRANSFER ROLL

CROSS REFERENCED INFORMATION

This application is a continuation-in-part of U.S. application Ser. No. 07/678,998, filed Jun. 28, 1991, now abandoned.

FIELD OF INVENTION

This invention concerns improvements in or relating to making corrugated board in which two fluted mediums are bonded together at their flute tips. In particular, this invention relates to improvements in the method of U.S. Pat. No. 4,886,563 of the apparatus which is the subject of U.S. patent application Ser. No. 155,217 now abandoned.

The critical aspect of forming corrugated board in accordance with U.S. Pat. No. 4,886,563 is to maintain the flute tip to flute tip orientation of the mediums until the liners have been bonded thereto, in order to obtain improved board strength. For this reason, the fluted layers must be constrained and handled carefully at all points of the process.

Corrugated board on which the fluted mediums are joined at their flute tips has never been produced in commercial volumes and the difficulties associated with handling such bonded mediums have not been addressed previously.

To this end the present invention provides a machine for making corrugated board, comprising means to feed two separate webs between two respective pairs of corrugating rolls to form two corrugated layers, a first adhesive application for applying adhesive to the peaks of at least one of the two corrugated layers, means to bring the two corrugated layers together at the peaks of the corrugations, means to convey the joined corrugated layers past a second adhesive applicator for applying adhesive to the exposed peaks of one of the corrugated layers, and means to apply a liner web to the corrugated layer having the adhesive on its peaks in which one of the corrugated webs carried by a first corrugating roll is arranged to be transferred to the corrugating web carried by a second one of the rolls, the first roll including a pressure chamber from which air pressure acts positively to assist the transfer of the corresponding web on to the other web and a portion of said vacuum chamber adjacent said pressure chamber incorporating means to phase out the negative pressure to provide an even transfer of said webs.

In another aspect, this invention provides a machine for making corrugated board, comprising means to feed two separate webs between two respective paris of corrugating rolls to form two corrugated layers, a first adhesive applicator for applying adhesive to the peaks of at least one of the two corrugated layers, means to bring the two corrugated layers together at the peaks of the corrugations, means to convey the joined corrugated layers past a second adhesive applicator for applying adhesive to the exposed peaks of one of the corrugated layers, and means to apply a linear web to the corrugated layer having the adhesive on its peaks in which the second corrugating roll includes a pressure chamber from which air pressure acts positively to assist the transfer of the joined corrugated webs onto a further roll arranged to carry the joined webs towards the second adhesive applicator and the portion of said vacuum chamber adjacent said pressure chamber incorporating means to phase out the negative pressure to assist in a smooth transfer of said joined webs to said further roll.

Preferably positive air pressure transfer may occur in both cases, that is from one corrugating roll to the second corrugating roll and from the second corrugating roll to the carrier roll which then transports the two fluted mediums past the second adhesive applicator.

The use of vacuum arrangements to retain corrugated mediums on rolls is known and generally in transferring a corrugated medium from one roll to another it is conventional to shut off the vacuum on one roll and to introduce it on the corresponding position of the second roll. This invention is predicated on the discovery that these conventional methods are inadequate for transferring the two mediums joined at their flute tips and lead to distortions in the orientation of the two joined mediums. The use of positive air pressure in the roll from which the joined mediums are being transferred complements the application of vacuum on the roll to which the joined mediums are being transferred. Because a different medium in the pair is associated with each of the two rolls, distortions can be avoided in this way. U.S. Pat. No. 4,338,154 (Berthelot et al.) discloses the use of a combination of a vacuum box and a compressed air box to transfer a conventional single faced board from one roll to another. This abrupt change from negative to positive pressure is too disruptive for boards having two fluted mediums joined at their flute tips.

In the present invention the rolls are designed to provide phased in change from negative to positive pressure on the roll from which the joined mediums are being transferred and this avoids undue stress to the joined mediums. The design includes the ability to externally adjust the cessation of vacuum to avoid the effect of rapid transition from negative to positive pressure on the paper webs.

In a preferred construction, the joined corrugated layers are conveyed by a roll along a path which, in the absence of pneumatic pressure, would result in the exposed peaks of the corrugated layer being spaced from the second adhesive applicator, the joined corrugated layers being urged pneumatically away from the roll by air pressure applied from within the roll so as to engage the adhesive applicator. This ensures uniform contact of the peaks of the corrugated layer with the adhesive applicator, which is preferably in the form of a roll coated with a thin layer of adhesive.

Other aspects of this invention, each useful in its own right and described in detail below, are concerned with the use of air pressure to lift one corrugated layer from its corrugating roll and into contact with the other corrugated layer, a construction of the second adhesive applicator including a weir over which a controlled flow of adhesive is arranged to pass into a gap between a fixed member and a moving roll arranged to convey adhesive from the gap and to apply it to the corrugated medium (preferably any excess is removed by a doctor roll or other doctoring device),and the mounting heaters and of the second adhesive applicator on one or more subsidiary frames separate from the main frame, preferably with means for moving these subsidiary frame or frames automatically away from the roll carrying the joined corrugated layers when the machine stops.

Figure 2:
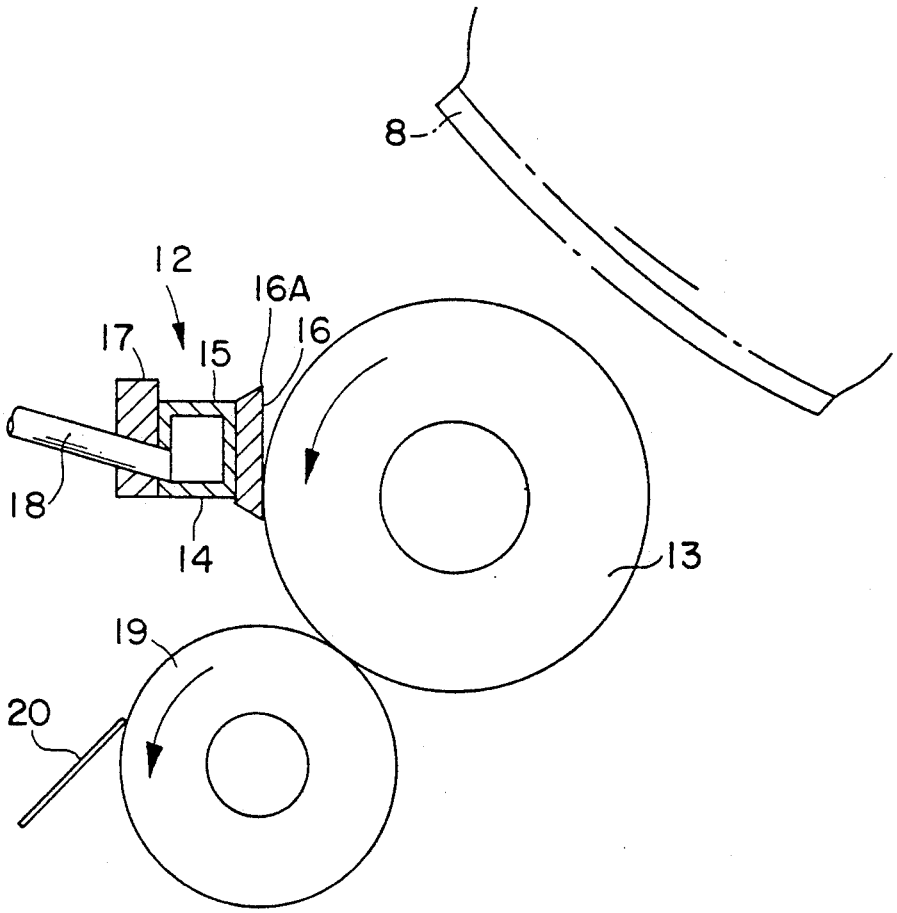
Figure 3:
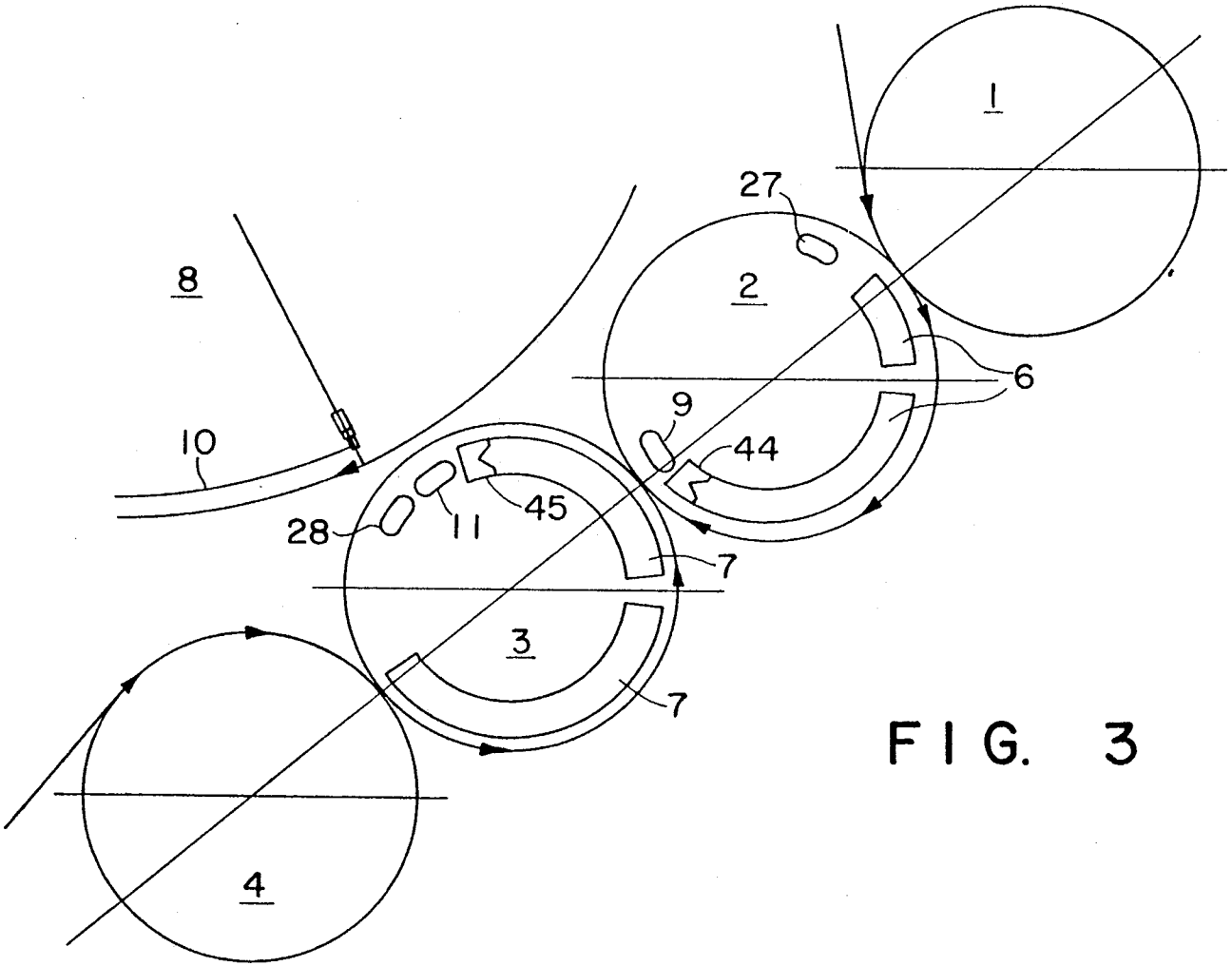

The invention will now be described, by way of example only, with reference to the accompanying drawings in which:

FIG. 1 is a diagrammatic side view of a machine for making corrugated board; and FIGS. 2 and 3 are enlarged detail of part of the machine of FIG. 1.

Referring to FIG. 1, a web W1 is corrugated in known manner between fluted corrugating rolls 1 and 2, and a web W2 is similarly corrugated between similar rolls 3 and 4. Adhesive is applied to the peaks of the corrugations by an applicator roll 5 and the corrugated webs W1, W2 are brought together between the rolls 2 and 3. The webs W1, W2 are held to their respective rolls 2, 3 by suction applied through chambers 6 and 7 respectively. The joined layers are then carried on the roll 3 towards a fluted carrier roll 8. As the adhesive at this stage is not yet tacky, the transfer in the roll 3 of the corrugated layer on roll 2 is assisted by the gradual reduction of negative pressure by the use of externally operated plates 44 to bring the pressure to atmospheric and then the layer W1 is lifted by air flow radially from a pressure chamber 9 in the roll 2 to finally achieve transfer.

After arrival on the roll 8, the joined corrugated layers are held on the fluted periphery of the roll by suction applied through a chamber 10. The externally operated plate 45 gradually reduce the negative pressure applied to the joined layers W1 and W2 to assist in their transfer to roll 8. The transfer from roll 3 to roll 8 is further assisted by pressure applied through a chamber 11 in the roll 3. As the joined layers are conveyed in a clockwise direction by the roll 8, adhesive is applied to the exposed (outwardly facing) peaks of the corrugated layer W2 by an adhesive applicator unit 12.

Referring now also to FIG. 2, the unit 12 comprises an applicator roll 13 which is positioned so that there is a small gap between its periphery and the peaks to which adhesive is to be applied. A container, in the form of a square tube 14, extends across the machine and has a hole 15 in its upper wall. A plate 16 is fixed to the tube so that its top edge 16A is higher than the top of the tube and a small gap is formed between it and the roll 13. A further plate 17 is also fixed to the tube 14, opposite the plate 16, so that its upper edge is higher than that of the plate 16. Thus the edge 16A of the plate 16 forms a weir, so that the amount of adhesive flowing over it and into contact with the roll 13 is substantially constant.

Adhesive is fed from a tank (not shown) along a pipe 18 into the tube 14 and out through the hole 15, so that it flows over the plate 16 onto the roll 13. Excess adhesive flows over the plate 17 and returns to the tank. The amount of adhesive carried on the roll 13 is metered by a roller 19 which, in turn, is cleaned by a doctor blade 20, and the adhesive is returned to the tank. As the roll 13 rotated with the correct amount of adhesive thereon, the joined layers being conveyed by the roll 8 pass a pressure chamber 21 in the roll 8 from which air flows through suitable radial passages so as to urge the joined layers outwards towards the roll 13. This causes contact with the roll 13 and adhesive to be applied to the peaks.

A liner W3 is fed around a roller 22 and applied to the adhesive-coated peaks of the outer corrugated layer formed by the web W2. Bonding at the liner to the peaks is assisted by heaters 23 and 24. The joined corrugated layers and the attached liner are then removed from the roll 8 by pressure air from chamber 25 and are fed over a plate 26 towards further processing machinery which forms no part of the present invention.

Pressure air is applied at chambers 27 and 28 provided in rolls 2 and 3 respectively so as to keep the suction holes in those roll clear of any debris.

The adhesive unit 12 is carried by a frame 29 which can move along a plate 30 on wheels 31. The frame has a toothed rack 32 fixed to it which is engaged by a pinion 33 driven by a motor 34.

The heaters 23 and 24 are carried by a frame 35 having wheels 36 which run on a plate 37. A toothed rack 38, fixed to the frame 35, is engaged by a pinion 39 driven by a motor 40.

The corrugating rolls and roll 8 are driven from a separate motor 41. The motors 34, 40, and 41 are connected to a central control unit 42, of a suitable known form, so that when the machine is stopped, the motors 34 and 40 are energized to rotate the respective pinions 33 and 39 and thus cause the adhesive unit 12 and the heaters 23 and 24 to be moved away from their respective operative positions.

A manual override is also provided so that the various units may be moved as and when the operator wishes.

I claim:

1. A machine for making corrugated board comprising means to feed two separate webs between two respective pairs of corrugating rolls to form two corrugated layers, a first adhesive applicator for applying adhesive to the peaks of at least one of the two corrugated layers, means to bring the two corrugated layers together at the peaks of the corrugations, means to convey the joined corrugated layers past a second adhesive applicator for applying adhesive to the exposed peaks of one of the corrugated layers, and means to apply a liner web to the corrugated layer having the adhesive on its peaks, in which one of the corrugated webs carried by a first corrugating roll is arranged to be transferred to the corrugating web carried by a second one of the rolls, the first roll including a vacuum chamber which acts to retain the corrugated web and a pressure chamber downstream of said vacuum chamber from which air pressure acts positively to assist the transfer of the corresponding web and a portion of said vacuum chamber adjacent said pressure chamber incorporating means to gradually change the negative pressure to positive pressure to provide an even transfer of said webs.

2. A machine for making corrugated board comprising means to feed two separate webs between two respective pairs of corrugating rolls to form two corrugated layers, a first adhesive applicator for applying adhesive to the peaks of at least one of the two corrugated layers, means to bring the two corrugated layers together at the peaks of the corrugations, means to convey the joined corrugated layers past a second adhesive applicator for applying adhesive to the exposed peaks of one of the corrugated layers, and means to apply a liner web to the corrugated layer having the adhesive on its peaks, in which the second corrugating roll includes a vacuum chamber to return the joined corrugated webs on said second roll and a pressure chamber downstream of said vacuum chamber from which air pressure acts positively to assist the transfer of the joined corrugated webs onto a further roll arranged to carry the joined webs towards the second adhesive applicator and the portion of said vacuum chamber adjacent said pressure chamber incorporating means to gradually change the negative pressure to positive pressure to assist in a smooth transfer of said joined webs to said further roll.

3. A machine according to claim 1 in which the joined corrugated layers are arranged to be conveyed past the second adhesive applicator by a roll including a pressure chamber from which air pressure acts to urge the corrugated layers onto the adhesive applicator.

4. A machine according to claim 2 in which the joined corrugated layers are arranged to be conveyed past the second adhesive applicator by a roll including a pressure chamber from which air pressure acts to urge the corrugated layers onto the adhesive applicator.

5. A machine according to claim 1 in which the second-mentioned roll includes a pressure chamber from which air pressure acts to assist the transfer of the joined corrugated webs onto a further roll arranged to carry the joined webs towards the second adhesive applicator.

6. A machine according to claim 1 including at least one heater adjacent to the means for carrying the joined corrugated webs and the applied liner web for promoting the bonding of the liner web.

7. A machine according to claim 2 including at least one heater adjacent to the means for carrying the joined corrugated webs and the applied liner web for promoting the bonding of the liner web.

* * * * *